United States Patent [19]

Vella

[11] Patent Number: 4,862,931

[45] Date of Patent: Sep. 5, 1989

[54] APPARATUS AND METHOD FOR REFILLING SELF-CONTAINED BREATHING APPARATUS

[76] Inventor: Louis J. Vella, 2615 Monserat Ave., Belmont, Calif. 94002

[21] Appl. No.: 184,764

[22] Filed: Apr. 22, 1988

[51] Int. Cl.[4] ..... A62B 7/00; B65B 31/00

[52] U.S. Cl. ..... 141/1; 141/4; 141/282; 141/237; 128/202.13; 128/205.25

[58] Field of Search ..... 128/202.13, 205.25, 128/206.25; 141/98, 1, 4, 37, 311 R, 387, 382, 383, 242, 243, 244, 237

[56] References Cited

U.S. PATENT DOCUMENTS

| | | | |
|---|---|---|---|
| 1,040,311 | 10/1912 | Halloran | 128/202.13 |
| 2,299,793 | 10/1942 | Cannaday et al. | 128/202.13 |
| 2,855,926 | 10/1958 | Koppleman | 128/202.13 |
| 4,153,083 | 5/1979 | Imler et al. | 141/4 |
| 4,165,738 | 8/1979 | Graves et al. | 128/202.13 |
| 4,331,139 | 5/1982 | Popa | 128/202.13 |
| 4,413,622 | 11/1983 | Austin | 128/205.25 |
| 4,467,796 | 8/1984 | Beagley | 128/202.13 |
| 4,542,774 | 9/1985 | Stavlo | 141/1 |

*Primary Examiner*—Ernest G. Cusick

*Attorney, Agent, or Firm*—Fliesler, Dubb, Meyer & Lovejoy

[57] ABSTRACT

A system for use in a structure for refilling portable self-contained breathing apparatus comprising a plurality of stations including a first station, an intermediate station and an end station, apparatus for coupling the first station to a source of compressed air, tubing for conducting compressed air from said first station to said intermediate and end stations and apparatus at each of said stations above or downstream from said first station for coupling said compressed air to said portable self-contained breathing apparatus. Air pressure indicators and valves for isolating an upstream station from a downstream station are also provided in each station.

7 Claims, 4 Drawing Sheets

APPARATUS AND METHOD FOR REFILLING SELF-CONTAINED BREATHING APPARATUS

BACKGROUND OF THE INVENTION

1. Field of the Invention

The present invention relates to emergency apparatus in general and in particular to a method and apparatus for providing compressed air to distributed stations in a building or other structure for use by emergency personnel, such as firefighters, to refill their self-contained breathing apparatus.

2. Description of the Prior Art

Upper floor highrise fire fighting and rescue work is normally performed from within the inside of a building due to the limitations of equipment operating on the ground. Firefighters fighting a fire and rescue workers working in other noxious atmospheres generally rely on portable, self-contained breathing apparatus to provide breathing air. Such apparatus typically comprises a high pressure cylinder filled with air at from 2200 psi up to 4500 psi. The self-contained breathing apparatus (SCBA) typically weighs 20–30 pounds and is designed to provide air for 15–30 minutes.

When a firefighter arrives at the scene of a highrise fire, for example, the firefighter suits up with heavy protective clothing and typically starts with a full SCBA. The firefighter must then climb to the location of the fire, often using just the stairs (elevators can be unreliable and dangerous during a fire). Even in the best of shape, the firefighter is panting for air by the time he or she reaches the fourth or fifth floor of the building. When the firefighter reaches the fire, which could be on one of the upper floors in a multi-story building, he or she may have to start using their SCBA. If this is necessary, it is all too common that within ten minutes or so, the SCBA is down to its reserve pressure and, until now, the person must return to the ground for a new SCBA cylinder. To avoid the resulting loss of time fighting the fire, often runners will be used to bring full cylinders to a staging area normally located one or two floors below the fire floor and return the empty cylinders to the ground. There, a portable compressor brought to the scene by the fire department is used to recharge the empty cylinders with new, clean air.

Another technique which has been used in the past is to have storerooms filled with spare air cylinders in various locations in the highrise. In either case, the use of runners or the use of spare cylinders are costly and very inefficient processes and severely handicap the ability of the firefighters to save lives and property.

Each highrise building, in addition to its elevators, comprises stairwells interconnecting each of the floors. Within the stairwell or a wall of the building it has been the practice to install a water standpipe. Located on each of the floors and coupled to the standpipe is a valve and outlet to which a firefighter can connect a fire hose for use in fighting a fire on that floor. Despite the fact that it has been the practice for many years to provide an adequate supply of water to each floor in a multi-story building for use in fighting fires thereon, and despite the fact that a long-felt need for refilling self-contained breathing apparatus in such situations has existed, it does not appear that anyone heretofore has provided an efficient method or apparatus for supplying compressed air to each of the floors to further assist firefighters to fight fires thereon.

What has been said above about the need for supplying air to stations on floors in a building applies with equal force in other structures, such as subways, mines and the like. In recent years there have been a number of incidents of fires in a subway which have required the use of SCBA by emergency personnel. All too often, however, the lack of a readily available apparatus to refill the SCBA seriously interfered with the rescue operations.

SUMMARY OF THE INVENTION

In view of the foregoing, principal objects of the present invention are a method and apparatus for providing a rescue air manifold system for use in a building having a plurality of floors, as well as in other types of structures, e.g. subways, mines, etc.

In one embodiment in which a system according to the present invention is installed in a multi-story building, there is provided a first station and a plurality of other stations which are located on all or selected floors of the building. The first station preferably is located on the outside of the building at a position easily accessible to emergency vehicles and in particular to an apparatus for providing compressed air.

In the first station there is provided a flexible air hose or the like for coupling the first station to a source of compressed air. In each of the other stations there is provided a flexible hose for coupling the station to a portable self-contained breathing apparatus for refilling said apparatus with compressed air. The individual stations are interconnected by means of rigid pipe. Also, each of the stations is provided with a pressure gauge for indicating the pressure of the compressed air in the system at that station. The pressure gauge is necessary in order to let emergency personnel know whether or not compressed air is available in the system to refill their portable self-contained breathing apparatus. An isolation valve is also provided in intermediate stations for use in isolating lower stations from accidental leaks in the system on upper floors, thereby preventing total disablement of the system.

BRIEF DESCRIPTION OF THE DRAWINGS

The above and other objects, features and advantages of the present invention will become apparent from the following detailed description of the accompanying drawing, in which.

DETAILED DESCRIPTION OF THE INVENTION

Figure 1:
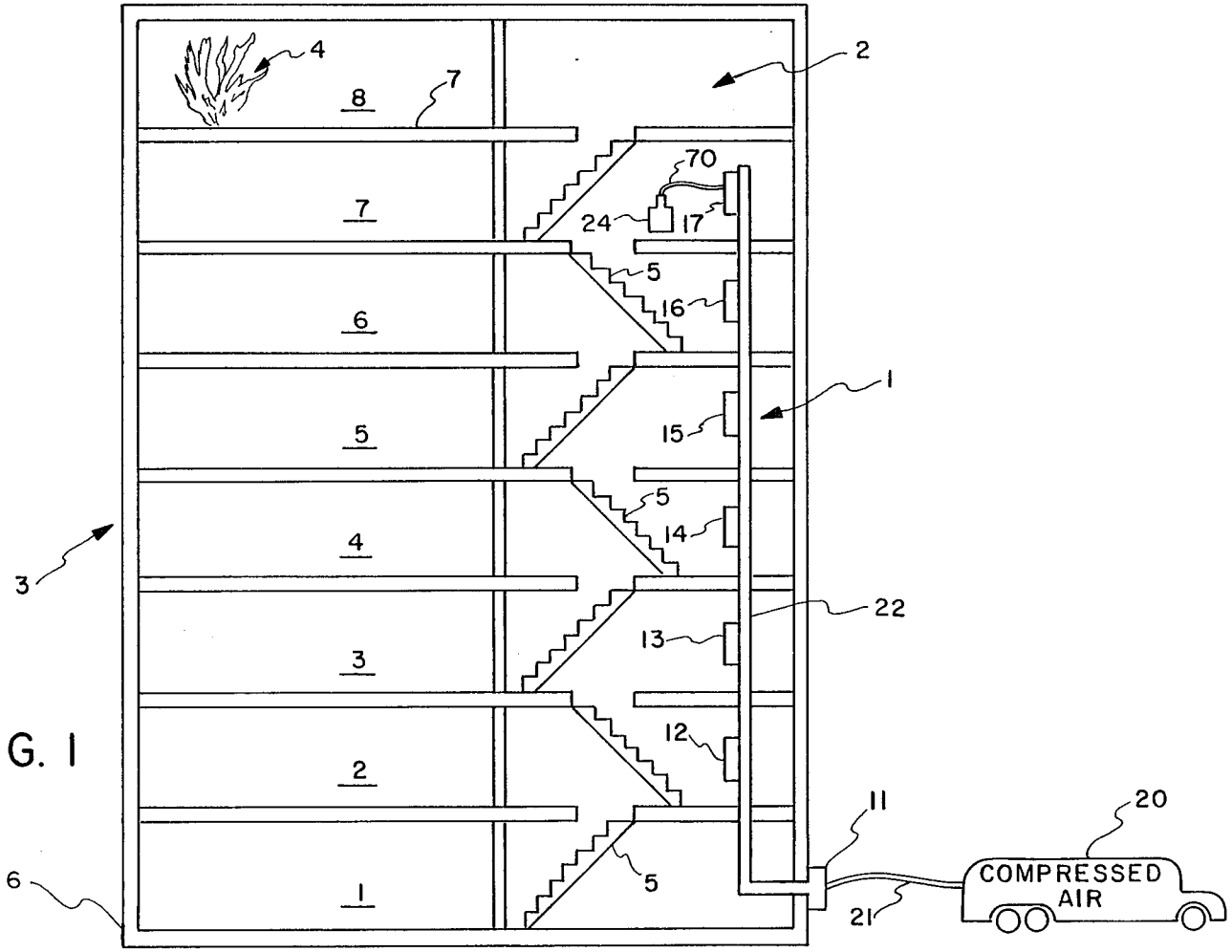
FIG. 1 is a diagrammatic representation of an eight-story highrise building.

Referring to FIG. 1, there is provided in accordance with the present invention a rescue air manifold system designated generally as 1 installed in the stairwell 2 of an eight story highrise building designated generally as 3. In the upper lefthand corner of the building 3 there is shown a representation of a fire 4. In the stairwell 2 there is shown a representation of a plurality of stairs 5 leading from the ground or first floor 6 to the top or eighth floor 7.

In the system 1 there is provided a first station 11, a plurality of intermediate stations 12–16 and an upper, top level or end station 17.

The first station 11 is preferably located on the outside of the building in a position accessible to emergency vehicles and, in particular, in a position accessible for the coupling thereto of a source of compressed air such as might be carried in an emergency vehicle such as represented by the truck 20. The source of compressed air in the truck 20 is coupled to the station 11 by means of a hose 21.

The first station 11 is connected to each of the other stations 12–17 by means of a rigid pipe 22. Each of the stations 12–17, as will be further described below, comprises a flexible line or hose 70 for coupling the station to a portable self-contained breathing apparatus 24 for filling said apparatus with compressed air. Typically, the stations need to be installed only to within one or two floors of the top of a building. This is because normal emergency techniques use staging areas one or two floors below an emergency floor.

Figure 2:
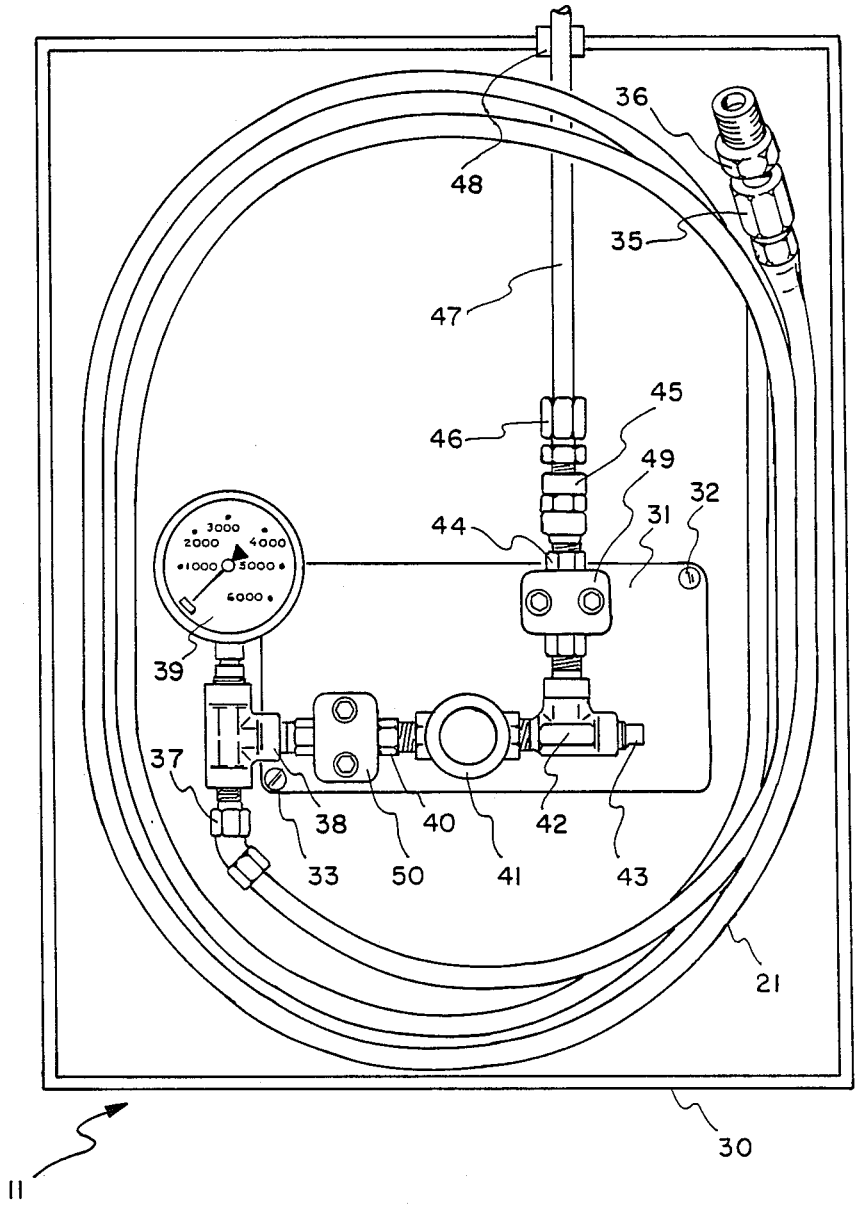
FIG. 2 is a front elevation view of a ground level station according to the present invention.

Referring to FIG. 2, there is provided in the first station 11 a recessed panel or enclosure 30. The enclosure 30 is typically provided with a key-locked door (not shown). In the interior of the enclosure 30 there is provided a mounting plate 31. Plate 31 is mounted to the rear wall of the enclosure 30 by means of a plurality of #12×$\frac{3}{8}$" self-tapping slotted screws 32, 33.

The hose 21, which is used for coupling the system 1 to a source of compressed air 20 as described above, is rated at 5000 psi, has an interior diameter of approximately $\frac{1}{4}$" and is typically 12 ft. long. Other lengths and sizes may be used as required. At the free end of the hose 21 there is provided a $\frac{1}{4}$" tube×$\frac{1}{4}$" NPT female connector fitting 35. Fitted into the connector 35 there is provided a male Scott Air Pak adaptor 36. Adaptor 36 is provided for coupling the station 11 to the source of compressed air 20. At its opposite end the hose 21 is coupled to a $\frac{1}{4}$" tube×$\frac{1}{4}$" NPT male 45° elbow fitting 37. The fitting 37 is coupled to one leg of a $\frac{1}{4}$" NPT, female pipe tee fitting 38. The opposite leg of the fitting 38 is coupled to a 0–6000 psi pressure gauge 39. The central leg of the fitting 38 is coupled to a $\frac{1}{4}$" NPT, 3" (long) pipe nipple 40. The opposite end of the nipple 40 is coupled to one end of a $\frac{1}{4}$" NPT hand valve 41. The opposite end of the hand valve 41 is coupled to a $\frac{1}{4}$" NPT street tee fitting 42. The opposite leg of the fitting 42 is provided with a $\frac{1}{4}$" NPT square head plug fitting 43. The central leg of the fitting 42 is coupled to a second $\frac{1}{4}$" NPT, 3" (long) pipe nipple 44. Nipples 40 and 44 are identical. The opposite end of the nipple 44 is coupled to a $\frac{1}{4}$" NPT pipe connector fitting 45. The pipe connector fitting 45 is in turn coupled to a $\frac{3}{8}$" tube×$\frac{1}{4}$" NPT male connector fitting 46. A $\frac{3}{8}$" OD×0.065 W stainless steel tubing 47 is connected to the station 11 by means of the fitting 46 and extends therefrom through a wall of the enclosure 30 through a hole provided therefor in a $\frac{3}{8}$" plug-type grommet 48. The length of the tubing 47 is chosen to be sufficient to reach the next higher, or adjacent station, e.g. station 12. Mounting clamps 49 and 50 are provided for attaching the above-described fittings to the plate 31.

Intermediate stations 12–16 are substantially identical and comprise many of the same parts described above with respect to station 11. Accordingly, only station 12 will be described in detail.

Figure 3:
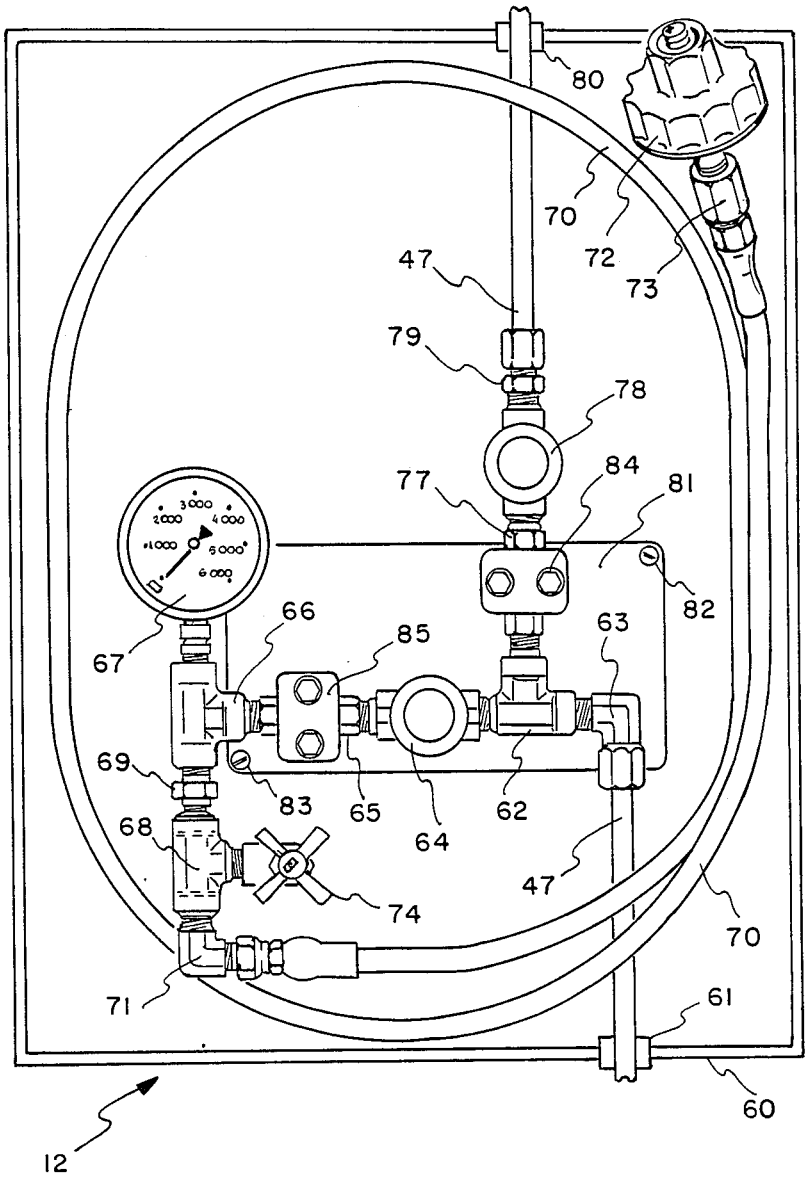
FIG. 3 is a front elevation view of an intermediate floor level station according to the present invention.
Figure 4:
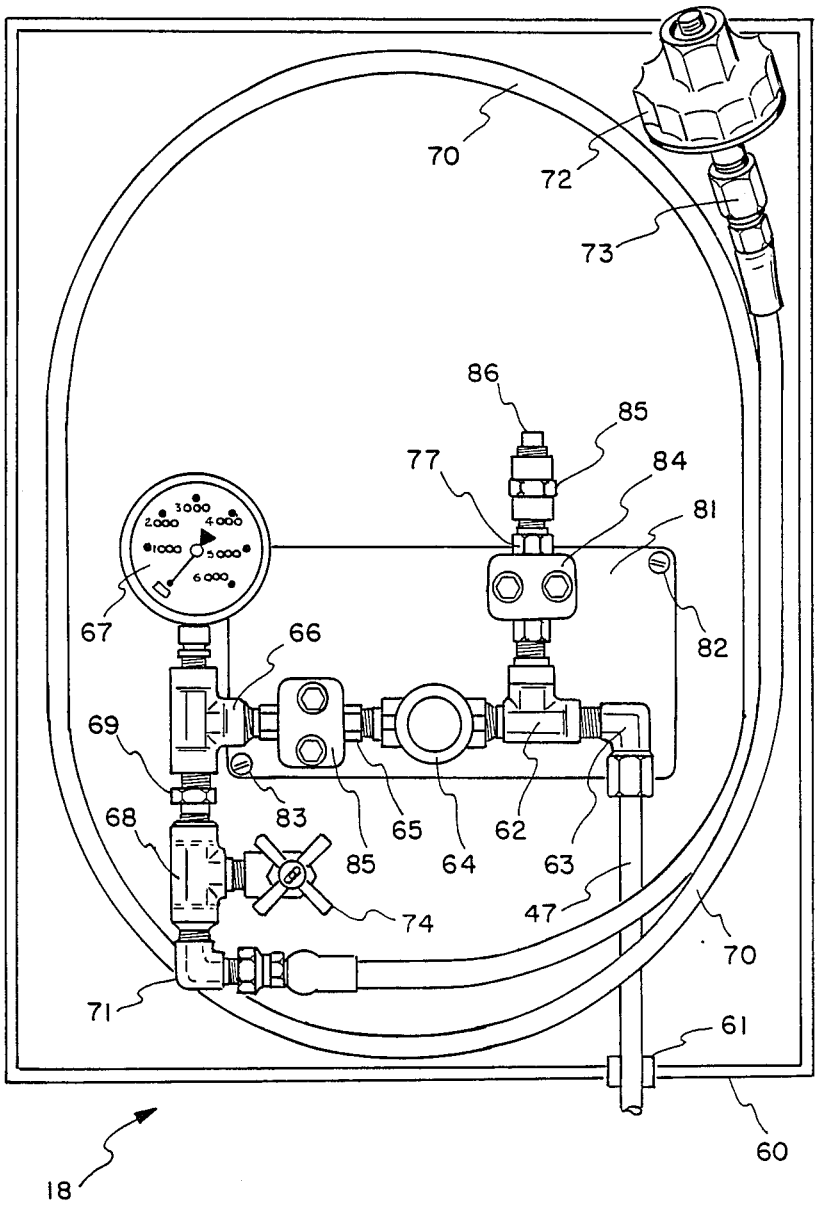
FIG. 4 is a front elevation view of the uppermost or top floor level station according to the present invention.

Referring to FIG. 3, there is provided in station 12 a recessed panel 60. The tubing 47 from station 11 enters the wall of the panel 60 through a $\frac{3}{8}$" plug-size grommet 61 and is coupled to one leg of a $\frac{1}{4}$" NPT street tee fitting 62 by means of a $\frac{3}{8}$" tube×$\frac{1}{4}$" NPT male elbow fitting 63. The opposite leg of the fitting 62 is coupled to one end of a $\frac{1}{4}$" NPT hand valve 64. The opposite end of the valve 64 is coupled to one end of a $\frac{1}{4}$" NPT×3" (long) pipe nipple 65. The opposite end of the nipple 65 is coupled to the center leg of a $\frac{1}{4}$" NPT female pipe tee fitting 66. Another of the legs of the fitting 66 is coupled to a 0–6000 psi pressure gauge 67. The opposite leg of the fitting 66 is coupled to one leg of a $\frac{1}{4}$" NPT male branch tee fitting 68 by means of a $\frac{1}{4}$" NPT pipe nipple fitting 69. The opposite leg of the tee fitting 68 is coupled to a $\frac{1}{4}$"×6', 5000 psi rated filling hose 70 by means of a $\frac{1}{4}$" NPT male elbow fitting 71. The free end of the hose 70 is provided with a Scott Air Pak filling adaptor 72 by means of a $\frac{1}{4}$" tube×$\frac{1}{4}$" NPT female connector fitting 73. The center leg of the fitting 68 is provided with a 5000 psi bleed valve 74.

The center leg of the fitting 62 is coupled to a $\frac{1}{4}$" NPT×3" (long) pipe nipple 77. The opposite end of the nipple 77 is coupled to a second $\frac{1}{4}$" NPT hand valve 78. The opposite end of the valve 78 is coupled to another length of the tubing 47 by means of a $\frac{3}{8}$" tube×$\frac{1}{4}$" NPT male connector fitting 79. The tubing 47 extends from the fitting 79 through an upper wall of the enclosure 60 through a $\frac{3}{8}$" plug-type grommet 80. Mounted to the rear wall of the recess panel 60 there is provided a mounting plate 81. Plate 81 is mounted to the rear wall of the recess panel 60 by means of a plurality of #12×$\frac{3}{8}$" self-tapping slotted screws 82, 83. The above-described fittings and valves are mounted to the plate 81 by means of a pair of tubing clamps 84, 85.

The upper level or end station 17 is identical to the intermediate stations 12–16 with the exception that the valve 78, fitting 79 and tubing 47 extending from the nipple 77 are replaced by a $\frac{1}{4}$" NPT pipe connector fitting 85 and a $\frac{1}{4}$" NPT square head plug fitting 86 to close off the system.

In use, the hose 21 from station 11 is coupled to a source of compressed air. The compressed air fills the tubing 47 and each of the pressure gauges 39 and 67 record the pressure in the system at their respective stations. When it is necessary to refill the tank of a self-contained breathing apparatus (SCBA), the SCBA is coupled to one of the stations by means of the Scott Air Pak filling adaptor 72. The valve 64 is then opened, allowing compressed air to pass through the tubing 47 from the station 11 through the nipple 65, the fitting 69, the tee fitting 68, the elbow 71 and the hose 70. After the SCBA tank is filled, the valve 64 is closed and the bleed valve 74 is opened, relieving the pressure in the line 70. A self-regulating check valve in the SCBA prevents an outflow of air from the tank. When the air pressure in the hose 70 is reduced to a safe level, the tank is disconnected from the Scott Air Pak filling adaptor 72 and the bleed valve 74 is closed.

If the system above or downstream from a particular station is ruptured such that there is a loss of compressed air therefrom, the valve 78 at the station below or upstream from the rupture is closed, by manually rotating the round knob shown in the drawing isolating said station and all lower or upstream stations from the rupture so as to preserve the continuity of the system up to said station. Alternatively, firefighters establishing a staging area for filling SCBA. on a given floor for use in fighting a fire on a higher floor in a multi-story building can manually close valve 78 in the station in the staging area so as to prevent a loss of air pressure from the system should a rupture of the system occur on a higher floor. For safety's sake, the closing of valve 78 immediately upon the establishment of a staging area is preferable to waiting until a breach of the system occurs on a higher floor.

While a preferred embodiment of the present invention is described above, it is contemplated that various modifications may be made thereto without departing from the spirit and scope of the present invention. For example, different sizes and types of fittings, valves and tubing may be used in particular applications to meet specific requirements of the building or other structure in which the system is installed and the self-contained breathing apparatus used therewith. Accordingly, it is intended that the embodiment described be considered only as an illustration of the present invention and that the scope thereof should not be limited thereto but be determined by reference to the claims hereinafter provided.

What is claimed is:

1. A method of filling the tanks of portable self-contained breathing apparatus in a structure comprising the steps of:

providing a first station;

providing a second station;

providing a third station;

connecting a first pipe means between said first station and said second station for conducting compressed air from said first station to said second station;

connecting a second pipe means between said second station and said third station for conducting compressed air from said second station to said third station;

providing a flexible air hose means in said first station;

connecting one end of said flexible air hose means located in said first station to a source of compressed air having a pressure in excess of 1000 p.s.i.g.;

providing a valve means in said first station between the opposite end of said flexible air hose means and said first pipe means for controlling the flow of said compressed air from said source of compressed air to said first pipe means;

providing a tank coupling means in said second station, including a fitting adapted to be removably attached to a tank used in a portable self-contained breathing apparatus;

providing a first valve means in said second station between said first and said second pipe means for controlling the flow of said compressed air from said first pipe means to said second pipe means;

providing a second valve means in said second station between said tank coupling means located in said second station and said first pipe means for controlling the flow of compressed air between said first pipe means and said tank coupling means located in said second station;

providing a third valve means in said second station having a first port thereof open to the atmosphere and a second port thereof connected to said tank coupling means in said second station for venting compressed air in said tank coupling means in said second station to the atmosphere;

providing a tank coupling means in said third station, including a fitting adapted to be removably attached to a tank used in a portable self-contained breathing apparatus;

providing a first valve means in said third station between said second pipe means and said tank coupling means in said third station for controlling a flow of compressed air between said second pipe means and said tank coupling means located in said third station; and providing a second valve means in said third station having a first port thereof open to the atmosphere and a second port thereof coupled to said tank coupling means in said third station for venting compressed air in said tank coupling means in said third station to the atmosphere.

2. A method according to claim 1 comprising the step of measuring the pressure of said compressed air in said system at said first, said second and said third stations, respectively.

3. A method according to claim 1 wherein said step of providing said tank coupling means in said second and said third stations comprises providing a flexible air hose with said fitting in said coupling means being located on one end of said air hose.

4. A compressed air manifold system in a structure for use in filling the tanks of portable self-contained breathing apparatus comprising:

a first station;

a second station;

a third station;

first pipe means connected between said first station and said second station for conducting compressed air from said first station to said second station;

second pipe means connected between said second station and said third station for conducting compressed air from said second station to said third station;

flexible air hose means located in said first station;

means located on one end of said flexible air hose means located in said first station for removably connecting said flexible air hose means located in said first station to a source of compressed air having a pressure in excess of 1000 p.s.i.g.;

valve means located in said first station between the opposite end of said flexible air hose means and said first pipe means for controlling the flow of said compressed air from said source of compressed air to said first pipe means;

tank coupling means located in said second station, including a fitting adapted to be removably attached to a tank used in a portable self-contained breathing apparatus;

first valve means located in said second station between said first and said second pipe means for controlling the flow of said compressed air from said first pipe means to said second pipe means;

second valve means located in said second station between said tank coupling means located in said second station and said first pipe means for controlling the flow of compressed air between said first pipe means and said tank coupling means located in said second station;

third valve means located in said second station having a first port thereof open to the atmosphere and a second port thereof connected to said tank coupling means in said second station for venting compressed air in said tank coupling means in said second station to the atmosphere;

tank coupling means located in said third station including a fitting adapted to be removably attached to a tank used in a portable self-contained breathing apparatus;

first valve means located in said third station between said second pipe means and said tank coupling means in said third station for controlling a flow of compressed air between said second pipe means and said tank coupling means located in said third station; and second valve means located in said third station having a first port thereof open to the atmosphere and a second port thereof coupled to said tank coupling means in said third station for venting compressed air in said tank coupling means in said third station to the atmosphere.

5. A system according to claim 4 comprising means in each of said first, said second and said third stations for measuring the pressure of said compressed air in said system at said first, said second and said third stations, respectively.

6. A system according to claim 4 wherein each of said tank coupling means in said second and said third stations comprises a flexible air hose and said fitting in said coupling means in located on one end of said air hose.

7. A system according to claim 4 wherein said structure comprises a multi-story building, said first station is accessible from the exterior of said building and said second and third stations are on a first and a second higher floor in said building, respectively.

* * * * *

UNITED STATES PATENT AND TRADEMARK OFFICE

CERTIFICATE OF CORRECTION

PATENT NO. : 4,862,931

DATED : September 5, 1989

INVENTOR(S) : LOUIS J. VELLA

It is certified that error appears in the above-identified patent and that said Letters Patent is hereby corrected as shown below:

Column 8, line 11, "in" should be --is--.

Signed and Sealed this

Fourth Day of September, 1990

*Attest:*

HARRY F. MANBECK, JR.

*Attesting Officer*

*Commissioner of Patents and Trademarks*